US010860044B1

(12) United States Patent
Trimberger

(10) Patent No.: US 10,860,044 B1
(45) Date of Patent: Dec. 8, 2020

(54) STRUCTURE AND METHOD FOR A MICROELECTRONIC DEVICE HAVING HIGH AND/OR LOW VOLTAGE SUPPLY

(71) Applicant: Xilinx, Inc., San Jose, CA (US)

(72) Inventor: Stephen M. Trimberger, Incline Village, NV (US)

(73) Assignee: XILINX, INC., San Jose, CA (US)

( * ) Notice: Subject to any disclaimer, the term of this patent is extended or adjusted under 35 U.S.C. 154(b) by 96 days.

(21) Appl. No.: 15/377,583

(22) Filed: Dec. 13, 2016

(51) Int. Cl.
*G05F 1/46* (2006.01)
*G05F 1/575* (2006.01)

(52) U.S. Cl.
CPC ..... *G05F 1/575* (2013.01); *G05F 1/46* (2013.01)

(58) Field of Classification Search
CPC ..... G05F 1/575; G05F 1/46; G05F 1/461
USPC ..... 327/538
See application file for complete search history.

(56) References Cited

U.S. PATENT DOCUMENTS 6,487,648 B1 11/2002 Hassoun
6,496,383 B1 * 12/2002 Herrell ..... H01L 23/50 174/250
6,932,618 B1 8/2005 Nelson
7,501,341 B1 3/2009 Von Herzen
7,608,931 B1 10/2009 Von Herzen
8,077,526 B1 12/2011 Schlachter et al.
8,923,463 B1 12/2014 Jenkins et al.
9,784,440 B2 * 10/2017 Erdener ..... F21V 23/007
2011/0012610 A1 * 1/2011 Chen ..... G11C 29/022 324/537
2011/0289335 A1 * 11/2011 Lipiansky ..... G06F 1/26 713/340
2012/0206989 A1 * 8/2012 Song ..... G11C 5/147 365/226
2013/0033941 A1 * 2/2013 Kim ..... G11C 5/14 365/185.29
2013/0058141 A1 * 3/2013 Oraw ..... H02J 1/102 363/60
2016/0087579 A1 * 3/2016 Moslehi ..... H01L 31/0516 136/251
2016/0179181 A1 * 6/2016 Doyle ..... G06F 1/3287 713/323
2017/0063229 A1 * 3/2017 Powell ..... G05F 1/59

OTHER PUBLICATIONS

Xilinx, Inc., User Guide, "Ultrascale and Ultra Scale+ FPGAs Packaging and Pinouts", Product Specification, UG575, v1.6, Apr. 25, 2016, pp. 01-335, San Jose, CA USA.

* cited by examiner

*Primary Examiner* — Patrick C Chen
(74) *Attorney, Agent, or Firm* — Patterson + Sheridan, LLP

(57) ABSTRACT

Apparatuses and methods relating generally to reduction of allocation of external power and/or ground pins of a microelectronic device are disclosed. In one such apparatus, an external power input pin is configured for receiving an input supply-side power having an external supply voltage level higher than an internal supply voltage level and an external supply current level lower than an internal supply current level. An internal power plane circuit coupled to the external power input pin is configured to step-down a voltage from the external supply voltage level to the internal supply voltage level and to step-up a current from the external supply current level to the internal supply current level to provide an internal power source.

19 Claims, 9 Drawing Sheets

STRUCTURE AND METHOD FOR A MICROELECTRONIC DEVICE HAVING HIGH AND/OR LOW VOLTAGE SUPPLY

FIELD OF THE INVENTION

The following description relates to integrated circuit devices ("ICs"). More particularly, the following description relates to a reduction of allocation of external power and/or ground pins of a microelectronic device.

BACKGROUND

Integrated circuits have become more "dense" over time, i.e., more logic features have been implemented in an IC of a given size. Number of pins, balls, bumps or other external contacts ("pins") of a packaged microelectronic device has likewise become denser leading to higher pin counts, though significantly less dense than logic features. Much of pin count includes power and ground pins, leaving fewer pins available as signal pins.

SUMMARY

An apparatus relates generally to reduction of allocation of external power pins of a microelectronic device. In such microelectronic device, an external power input pin is configured for receiving an input supply-side power having an external supply voltage level higher than an internal supply voltage level and having an external supply current level lower than an internal supply current level. An internal power plane circuit is coupled to the external power input pin and configured to step-down a voltage from the external supply voltage level to the internal supply voltage level and to step-up a current from the external supply current level to the internal supply current level to provide an internal power source.

Another apparatus relates generally to reduction of allocation of external ground pins of a microelectronic device. In such a microelectronic device, an external ground pin is configured for receiving a sink-side output power having a negative external sink voltage level below a ground voltage level. An internal ground plane circuit is coupled to the external ground pin and configured to either step-down a voltage from the ground voltage level down to the negative external sink voltage level or step-up a voltage from the negative external sink voltage level up to the ground voltage level. The internal ground plane is further configured to step-down a current from an internal supply current level to an output current level.

A method relates generally to regulating a power system of a microelectronic device. In such a method, an input supply-side power is received to an external power input pin. The input supply-side power has an external supply voltage level higher than an internal supply voltage level. The input supply-side power is provided to an internal power plane circuit coupled to the external power input pin. A voltage is stepped down from the external supply voltage level to the internal supply voltage level by the internal power plane circuit to provide an internal power source.

Other features will be recognized from consideration of the Detailed Description and Claims, which follow.

BRIEF DESCRIPTION OF THE DRAWINGS

Accompanying drawings show exemplary apparatus(es) and/or method(s). However, the accompanying drawings should not be taken to limit the scope of the claims, but are for explanation and understanding only.

FIG. 2-1 is a block diagram depicting an exemplary packaged microelectronic device for a power input side.

FIG. 2-2 is a block diagram depicting another exemplary packaged microelectronic device for a power input side.

FIG. 2-3 is a block diagram depicting yet another exemplary packaged microelectronic device for a power input side.

FIG. 3-1 is a block diagram depicting an exemplary packaged microelectronic device for a ground input/output side.

FIG. 3-2 is a block diagram depicting another exemplary packaged microelectronic device for a ground input/output side.

DETAILED DESCRIPTION

Figure 1:
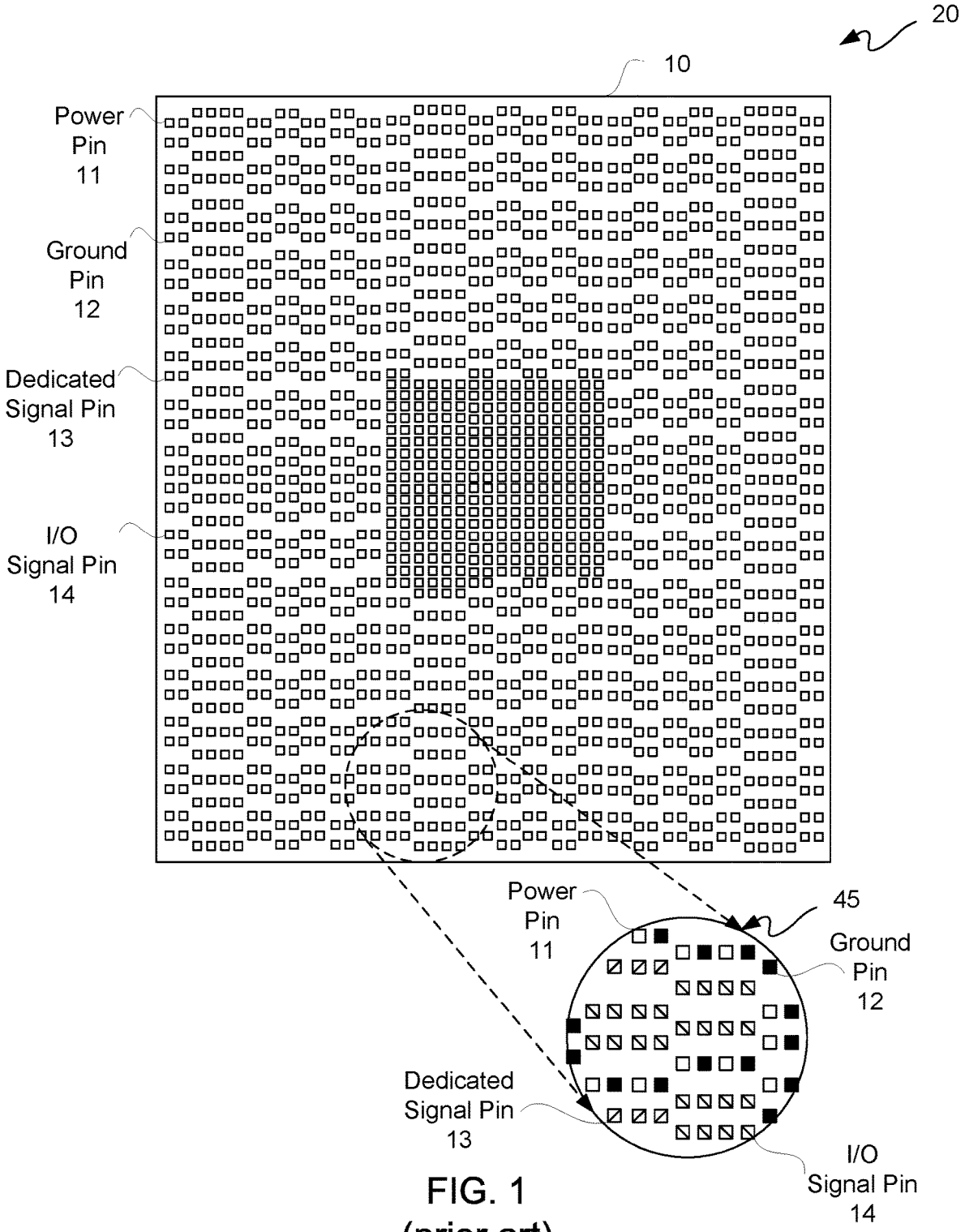
FIG. 1 (prior art)
FIG. 1 is a block diagram depicting an exemplary pinout, such as may be associated with a previously known microelectronic device.

In the following description, numerous specific details are set forth to provide a more thorough description of the specific examples described herein. It should be apparent, however, to one skilled in the art, that one or more other examples and/or variations of these examples may be practiced without all the specific details given below. In other instances, well known features have not been described in detail so as not to obscure the description of the examples herein. For ease of illustration, the same number labels are used in different diagrams to refer to the same items; however, in alternative examples the items may be different.

Exemplary apparatus(es) and/or method(s) are described herein. It should be understood that the word "exemplary" is used herein to mean "serving as an example, instance, or illustration." Any example or feature described herein as "exemplary" is not necessarily to be construed as preferred or advantageous over other examples or features.

Before describing the examples illustratively depicted in the several figures, a general introduction is provided to further understanding.

Moore's law predicts an increase in the number of gates of a microelectronic device. However, while the number of gates may increase, the number of external physical contacts for electrical conductivity to and from such a microelectronic device may not increase as rapidly due to physical constraints, including without limitation minimum size of such external physical contacts and available surface area of such microelectronic device for such physical contacts ("pins").

Based on designs directed to power and ground distribution, signal integrity and other factors, a significant number of pins of a microelectronic device are dedicated to either power or ground. However, for a same amount of power or charge, if voltage is increased by a factor of N, then current is decreased by a factor of N. The number of power and/or ground pins, which are current limited, may be reduced by increasing magnitude of input voltage, positive and negative respectively, and correspondingly decreasing input and/or output current.

As described below in additional detail, a microelectronic device, including without limitation a packaged microelectronic device, with fewer power and/or ground pins is provided by inclusion of a power plane and/or ground plane circuit, respectively. Along those lines, voltage is increased in magnitude while correspondingly decreasing magnitude of current. This allows for a same amount of charge to be input to and/or output from a microelectronic device, while having a reduced current level as power and ground pins have current limits. For purposes of clarity by way of example and not limitation, a packaged microelectronic device for a microelectronic device is assumed. For the same power, by increasing voltage on the outside of a supply side of a packaged microelectronic device ("Vext"), and stepping down such Vext in such packaged microelectronic device to provide an internal voltage ("Vint"), external current provided with such Vext may be reduced, such as from a conventional current level, by a factor as Vext/Vint. Therefore, fewer power pins may be used by such a packaged microelectronic device. Having to allocate fewer physical pins in a pinout to power may allow such unused or unallocated power pins to be used or interconnected for other purposes, such as for example data signals. While the above description was for a voltage input side, a similar use may be implemented on a voltage output side or Vss. For example, on a ground side of a packaged microelectronic device, a negative external voltage may be provided for input. Such negative external voltage may be internally stepped up in such packaged microelectronic device to a ground voltage level to reduce a number of ground pins by a corresponding ratio of external to internal voltages for such voltage output side.

With the above general understanding borne in mind, various configurations for a packaged microelectronic device are generally described below.

FIG. 1 is a block diagram illustratively depicting an exemplary pinout 20, such as may be generally associated with a previously known microelectronic device 10. Microelectronic device 10 may be a VLSI circuit chip or other type of IC device or die.

There are many known examples of pinouts of microelectronic devices. The following description is not limited to any particular pinout.

A microelectronic device 10 may have many pins, balls, bumps, or other external contacts ("pins") for conducting electricity to or from such device, whether in the form of an AC voltage, a DC voltage, a signal, or other form of conduction of electricity. A significant number of these pin are external power pins ("power pins") 11 and external ground pins ("ground pins") 12. Generally, approximately a third to a half of all pins on a previously known VLSI microelectronic device 10 may be power and ground pins.

There are many types of power pins 11 and generally at most a few types of ground pins 12. Ground pins 12 generally refer to a 0 volts voltage level. Ground pins 12 in an FPGA for example may include a conventional ground ("GND"), a reserved ground ("RSVDGND"), and a ground for an analog-to-digital converter ("ADC"), namely GNDADC which is less noisy than a conventional ground. All of these types of ground pins 12 are for a zero voltage level. In practice, these ground pins may be connected to the same external ground signal or to separate external ground connections, even though they supply the same zero volts voltage level. Further, multiple physical power pins may connect to the same ground signal rail inside the semiconductor package or on the semiconductor die. Power pins 11 may be any of a number of different voltage and/or amperage levels. For the example of an FPGA device, such power pins 11 may include VRATT, VCC AUX_IO, VCC AUX, VCC INT, VCC INT_IO, VCCDRAM, VCC ADC, MGT AVCC, MGT AVTT, and MGT VCC AUX. However, these are just some externally provided voltage levels, and even more voltages levels may be generated internally within a microelectronic device 10 using one or more internal voltage regulators ('IVRs"). Moreover, even though an FPGA is used as an example, any other microelectronic devices having approximately a third to half of all pins or other external interconnects committed to power and ground may benefit from one or more aspects of the technology described herein.

In addition to power pins 11 and ground pins 12, there may be dedicated signal ("dedicated") pins 13, and I/O signal ("I/O") pins 14, including without limitation multi-function I/O pins. These and/or other types of pins may be included in a pinout 20; however, the following description pertains to power pins 11 and ground pins 12, namely reducing the amounts of either or both power pins 11 or ground pins 12. While the following description is directed at a conventional ground pin 12 and an internal supply voltage ("VCC INT") power pin 11, it will be appreciated from the following description that these and/or other types of power and/or ground pins may be used. For purposes of clarity by way of example and not limitation, enlarged circular area 45 illustratively depicts external power pins 11 as unfilled boxes, external ground pins 12 as filled boxes, dedicated pins 13 as boxes with slashes, and I/O pins 14 as boxes with back slashes. Of course, actual pin allocation may vary from packaged microelectronic device-to-packaged microelectronic device, and pins in this FIG. 1 are for purposes of illustration only not representing an actual implementation of a pinout.

It should be appreciated that the number of pins on a microelectronic device 10 may be limited by physical size of such device, minimum spacings between pins, minimum size of pins, and other factors. Moreover, the amount of power a microelectronic device 10 may draw at an instant of time may be limited, and so it may be that not all pins on a device are active at the same time so as not to exceed a maximum current or other limitation of a microelectronic device 10.

Each external power pin 11 and external ground pin 12 on a microelectronic device 10 has a limit as to how much current can pass through such pin. For example, each power pin 11, and each ground pin 12, has an associated resistance and an associated inductance which limit the amount of current that can safely pass through such pin. Moreover, as demand for number of pins increases, size of such pins may be reduced further limiting a pin's current limit. For purposes of clarity by way of example and not limitation, it shall be assumed that a pin's current limit is 100 milliamperes ("mA"), though other pin current limits higher or lower than 100 mA may be used in other implementations.

For example, suppose power to operate a microelectronic device 10 for a one-volt ("V") supply voltage level is 10 watts ("W"), then 10 amperes or amps ("A") would be needed to operate such a microelectronic device. At a 100 mA limit per power pin 11, at least 100 (i.e., 100×100 mA=10 A) power pins 11 may be needed, and at least an additional 100 ground pins 12 may be needed. Thus, such a same microelectronic device 10 could be scaled up for additional capacity and/or functionality to operate at 100 W, then at least 1000 power pins and at least 1000 ground pins may be needed to operate such scaled up microelectronic device. The above example is for purposes of clarity by way of example and not limitation, accordingly it should be appreciated that these and/or other values may be used as may vary from microelectronic device-to-microelectronic device.

Again, the number of pins a microelectronic device 10 may have is constrained by above-described physical limitations. If this number of pins is substantially impacted by having to have power and ground pins to provide enough power to a device for proper operation thereof, then there are fewer pins available for dedicated pins 13 and/or I/O pins 14. Effectively, the amount of user interface activity associated with dedicated pins 13 and/or I/O pins 14 a microelectronic device 10 may have may be limited by having to allocate a significant number of pins as power pins 11 and ground pins 12 in order to power such microelectronic device 10. Moreover, in order to power such microelectronic device 10 through power pins 11 and ground pins 12, a significant number of each of those pins are used. How many pins are to be allocated as power pins 11 and ground pins 12 puts an upper limit on how much functionality a microelectronic device 10 may have due to an upper power limit associated with a maximum allocation of power pins 11 and ground pins 12.

It should be appreciated that not all power and/or ground pins may be allocated exclusively for meeting a target power consumption number. Sometimes power and/or ground pins are used for signal integrity and other reasons.

Figure 9:
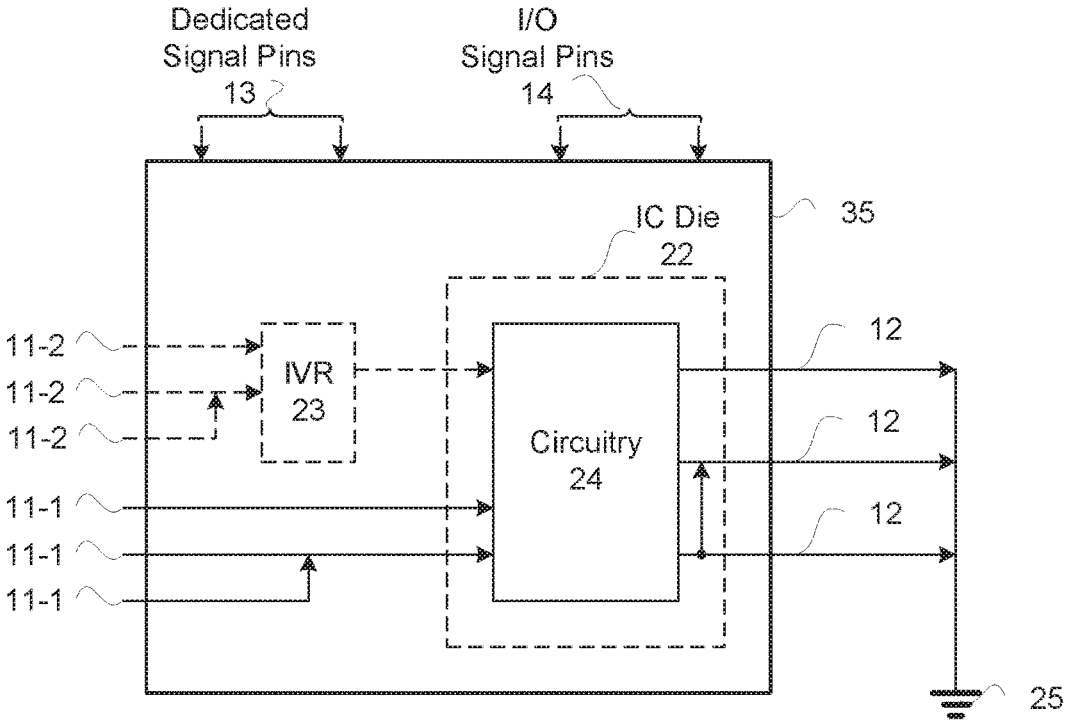
FIG. 9 (prior art)
FIG. 9 is a block diagram depicting an exemplary previously known packaged microelectronic device.

FIG. 9 is a block diagram illustratively depicting an exemplary previously known packaged microelectronic device 35 coupled to an external ground 25. Input power is provided, such as at a conventional external voltage level, for die internal circuitry ("circuitry") 24 via one or more external power pins 11-1. External power pins 11-1 may be connected to traces or other wires inside packaged microelectronic device 35, and such traces or other wires may be shorted together inside packaged microelectronic device 35 before interconnects to circuitry 24 for supplying power to circuitry 24.

Input power may optionally be converted to another conventional voltage level using an internal voltage regulator ("IVR") 23 for supplying such other conventional voltage level to circuitry 24. IVR 23 may be internal to packaged microelectronic device 35. External power pins 11-2, which likewise may be interconnected to traces or other wires shorted together inside packaged microelectronic device, may be interconnected to IVR 23 for supplying power thereto. IVR 23 is shown separately from circuitry 24, but may be integrated on the same integrated circuit die 22 as circuitry 24 in another implementation.

Circuitry 24, which may be in an integrated circuit die 22 within microelectronic packaged device 35, may be interconnected to have external ground pins 12. Ground traces or other wires from circuitry 24 may be interconnected to external ground pins 12. Again, such ground traces or other wires may be shorted together before interconnects to package external ground pins 12. External ground pins 12 may be commonly coupled to an external ground 25.

Packaged microelectronic device 35 may have multiple external power pins 11 and multiple external ground pins 12 because each of these external pins 11 and 12 is limited in the amount of current it can supply or carry. So collectively such external pins 11 and 12 may allow for input and output, respectively, of a sufficient amount of current for operation of circuitry 24.

Figures 1, 2:
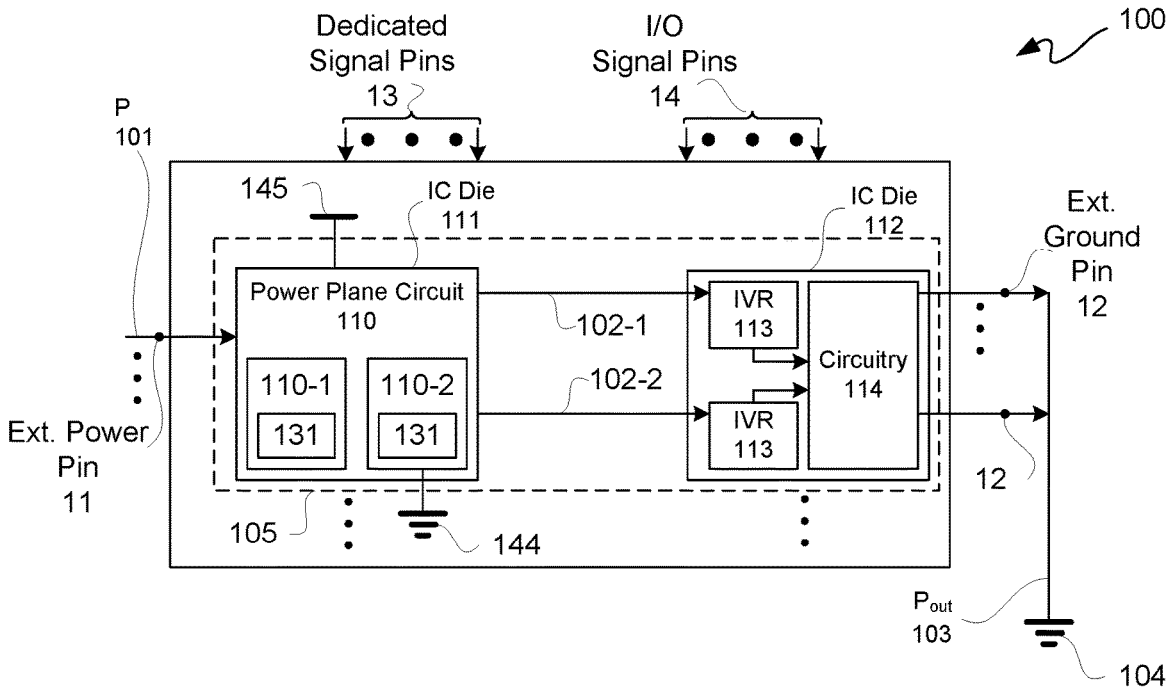
Figure 2:
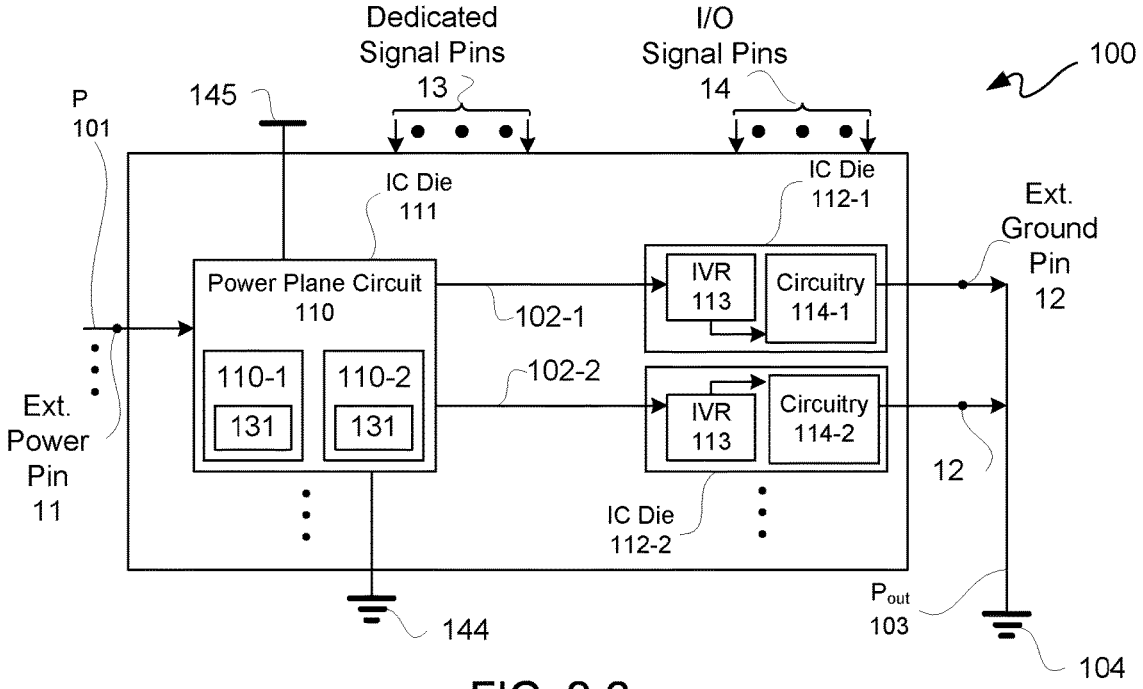

FIG. 2-1 is a block diagram illustratively depicting an exemplary packaged microelectronic device ("microelectronic device") 100. Input power ("P") 101 may be provided to microelectronic device 100 via an external power pin 11. Input power, P, 101 is equal to input current, I_ext, multiplied with input external voltage, Vext. However, input current, I_ext, is reduced from for example a conventional input current level by a constant amount, $c_1$. In other words, input current, I_ext, equals $I_{in}(1-c_1)$, where input current, $I_{in}$, is a conventional input current level in this example. External supply current level for I_ext may be internally stepped up for an internal supply current level for I_int corresponding to a step down in voltage, as described below.

Inversely, input external voltage, Vext, is increased from for example a conventional input external voltage level by a constant amount, $c_2$. In other words, input external voltage, Vext, is increased to $Vext(1+c_2)$; or stated another way Vext is equal to $Vint(1+c_3)$ where internal voltage, Vint, is a conventional internal or supply voltage level in this example and $c_3$ is a constant. Thus, an external supply voltage level of Vext may be stepped down to an internal supply voltage level of Vint, with a corresponding stepping up of internal current I_int from an external current I_ext level.

By having more voltage overhead on a power side of a microelectronic device 100, less current may be used. In other words, by having a greater voltage spread, current per pin may be reduced for providing an equivalent amount of power. For a same input power level, such as for example a conventional input power level, voltage may be increased while inversely reducing current to provide a same amount of power. Pin resistances cause voltage drops inside a packaged device by current passing through such pins according to voltage equal to current multiplied by resistance or "V=IR", and so higher current means more voltage drop from an input voltage to an internal voltage. Current demand may vary among devices and over time; however, generally higher current on pins leads to less predictability with respect to internal voltage, which may lead to less predictable performance and power consumption. If an internal voltage drops too low due current-resistance ("IR") loss, then a packaged microelectronic device may not properly operate.

As described herein, generally a same amount of power may be input with less current resulting in less IR internal voltage drop. Additionally, by reducing current, a packaged part may have fewer issues associated with heating. Optionally, for being able to use less current, current carrying size of power pins 11 may be reduced, so as to have a smaller cross-sectional area with a lower maximum current than a conventional power pin by comparison. Having pins with a smaller cross-sectional area may be used to increase the number of pins on a device. However, in another implementation, same size pins may be used for reducing pin count as compared with a conventional packaged microelectronic device 35, as described below in additional detail. Generally, having a reduction in pins, amount and/or size, allocated for power and ground allows for more pins or area for more pins to be used for data or other signals.

Without reduction in size of power pins 11, a number of external power pins 11 of microelectronic device 100 may be reduced. In other words, rather than having a number of same and/or different voltages ("different voltages") input through a number of different external power pins 11, such number of external power pins 11 may be replaced by a single external power pin 11 delivering a higher input voltage than all of such different voltages or at the highest voltage for stepping down such higher input voltage internally within such microelectronic device 100 for internally providing such different voltages. By reducing a number of external power pins 11 from the number used for example on a conventional packaged microelectronic device 35 in order to collectively supply a sufficient amount of current, more pins may be available for having more dedicated pins 13 and/or I/O pins 14, and/or by reducing size of external power pins 11, more area for other pins may be opened up, such as for having more dedicated pins 13 and/or I/O pins 14. Optionally, the total number of packaged microelectronic device 35 pins may be reduced leading to lower cost and/or smaller die size.

As semiconductor technology has improved, the number of transistor gates has increased significantly for microelectronic devices, including without limitation packaged microelectronic devices, having a single IC die or having two or more IC dies interconnected to one another; however, the number of pins for such devices has not increased as rapidly. Therefore, even if the number of pins is the same, ability to use fewer of such pins for power and/or ground and reallocate freed-up pins to dedicated pins 13 and/or I/O pins 14 may be significant. By providing additional I/O pins 14 for example, a desired input/output bandwidth may be achieved by using more pins for signaling at a lower frequency leading to lower overall power consumption. For example, operating transceivers at high data rates for high-speed communication is problematic, if twice the number of I/O pins 14 may be used for by transceivers, then data rate for such transceivers may be cut in half. This is just one of many examples of how having more pins available for activities other than power and/or ground may be valuable.

In view of the above-description, it should be understood that each external power input pin 11 and each external power output or ground pin 12 has a current limit. However, an amount of charge to power a device may be allocated differently with respect to current and voltage. In other words, even though current is reduced and voltage is increased to provide an input power or output power charge flow capability, the amount of input power or output power, namely the amount of charge going into or out of a device, is basically the same. Thus, a current limit of a pin may be avoided or reached while providing a same amount of input or output flow of charge by reducing overall externall provided current and correspondingly increasing overall externally provided voltage.

While there is not a specific minimum voltage difference leading to pin savings, higher differences in voltage between an external voltage, Vext, and an internal voltage, Vint, may lead to greater savings in external pins and/or make more external pins available for reallocation away from power or ground. In the example of FIG. 2-1, an external power input pin 11 may be configured for receiving a supply-side input power 101 having an external supply voltage level Vext at least fifty percent higher than a voltage level of corresponding internal supply voltage level Vint, namely Vext is equal to or greater than 1.5Vint. In another example, the Vext may be a voltage available on a board, which houses packaged microelectronic device 100. By way of example and not limitation, an externally supplied voltage Vext may be 12 volts as compared to approximately a 1 volt internal voltage level Vint. Therefore, the range of a multiplier of input internal voltage for an external voltage used for sourcing internal voltages may have a wide range. This range may vary from application-to-application. However, for purposes of clarity by way of example and not limitation, it shall be assumed that external supply voltage level Vext is 3 volts and that internal supply voltage level Vint is 1.8 volts. Such an external power input pin 11 may have an input current limit, so at most an input supply-side power P may be equal to or at least approximately equal to such external supply voltage level Vext multiplied by such an input current limit. For purposes of clarity by way of example and not limitation, it shall be assumed that Vext is used to power core logic, processor cores, and/or other circuitry associated with transistors used for logic and/or processing functions ("core logic"). While Vext may be used to power circuitry other than core logic, such other circuitry in some implementations may continue to be powered for example with a conventionally supplied voltage.

An internal power plane circuit 110, namely a power plane circuit 110 internal to microelectronic device 100, may be coupled to external power input pin 11 and may be configured to step-down voltage from such an external supply voltage level Vext to a desired internal voltage level, such as for example a conventional internal supply voltage level Vint, to provide at least one internal power source 102 even though two internal power sources 102-1 and 102-1 are illustratively depicted. Power plane circuit 110 may be coupled to a reference input voltage 145 and/or a reference ground voltage 144 to provide reference levels for voltage step down. Power plane circuit 110 may be thought of as converting input power 101 into one or more output powers for one or more correspond internal power sources 102. Power plane circuit 110 may include one or more voltage converters or voltage regulators, such as voltage step-down circuits 110-1 and 110-2 for example, for converting, such as by stepping down voltage, from an input external voltage level Vext to one or more same or different desired internal voltage levels, such as for example conventional internal supply voltage levels Vint, to provide at least one internal power source 102. Additionally, such one or more voltage step down circuits, such as voltage step-down circuits 110-1 and 110-2 for example, may correspondingly be configured for stepping up current from an external amperage level I_ext to one or more internal supply current levels I_int corresponding to such one or more internal supply voltage levels Vint. Each voltage step-down circuit 110-1 and 110-2 may include a corresponding internal voltage regulator or converter ("IVC") 131.

Figure 8:
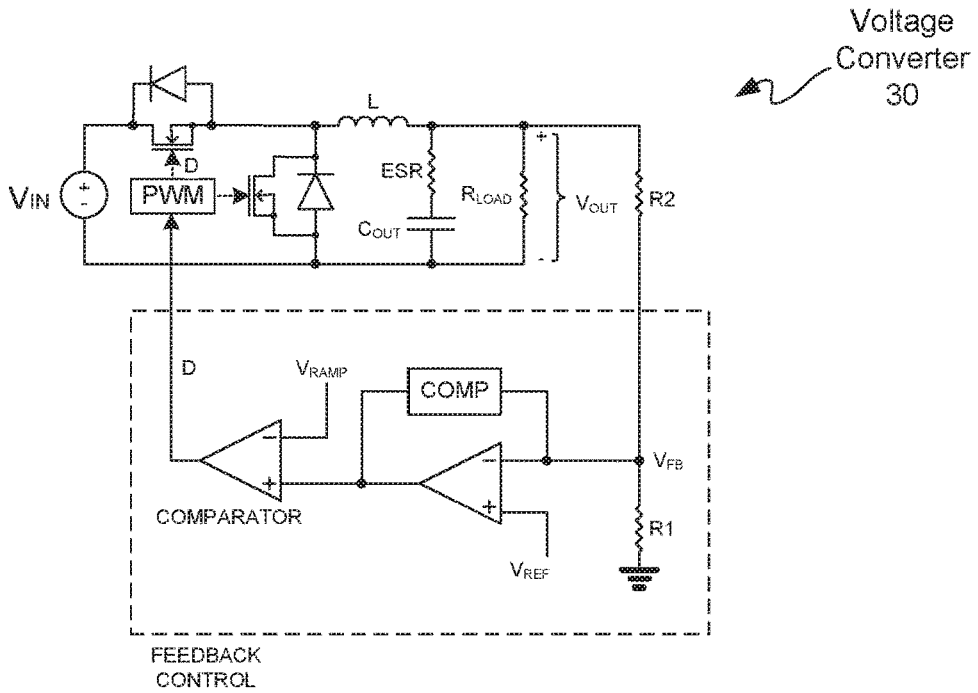
FIG. 8 (prior art)
FIG. 8 is a schematic diagram depicting an exemplary previously known internal voltage converter.

There are many known implementations for voltage converters or voltage regulators, and so each is not described herein in unnecessary detail for purposes of clarity and not limitation. However, for purposes of clarity by way of non-limiting example, FIG. 8 is a schematic diagram illustratively depicting an exemplary previously known voltage converter 30. Voltage converter 30 may, for purposes of non-limiting example, be used in a power plane circuit 110. In voltage converter 30, an external voltage to voltage converter 30 may be the voltage source for the converter labeled Vin, which may be analogized to Vext, and $R_{load}$ indicates load of a device to be powered at voltage Vref which may be analogized to Vint at a current I_int. As voltage converter 30 is well known, such voltage converter 30 is not described in unnecessary detail for purposes of clarity and not limitation. While voltage converter 30 may be for stepping down voltage, one of ordinary skill in the art may convert voltage converter 30 for stepping up voltage using a ground reference voltage input to an operational amplifier ("op amp") and building out corresponding feedback and other circuits. Voltage converter 30 or the like may be used as an IVR 131.

Returning to the example of FIG. 2-1, power input to internal power plane circuit 110 may be apportioned, evenly or unevenly, to one or more power outputs, which may be a same or different voltage levels and/or same or different current levels. In this example, power plane circuit 110 is configured to provide two internal power sources 102-1 and 102-2, with total power approximately P=Vext*I_ext, the voltage and current outside the package. For example where each of such internal power sources 102 may provide an output power $p_{out}$ with a total power of such output powers approximately equal to I_int*Vint. As current may be allocated to multiple locations, a current reduction or allocation factor may be used for implementations with two or more output powers from two or more internal power sources 102.

Internal voltage Vint may be a conventional voltage level suitable for an integrated circuit in contrast to input external voltage Vext, which may be in excess of a conventional external voltage level as associated with powering "core logic" or other logic. Generally, power input to a power plane circuit 110 may be divided among multiple internal power outputs at same and/or different voltage levels, or power input to a power plane circuit 110 may be provided as a single internal power output at Vint. For purposes of clarity by way of example and not limitation, input external voltage Vext may be 3 volts at a current of 500 mA for a power of 1.5 watts, and power plane circuit may have a gross output at an internal voltage Vint at 1.8 volts with a current of 833 mA, and such current of 833 mA may be allocated among multiple power drawing circuits. For purposes of clarity by way of example and not limitation, one power drawing circuit may be provided with 500 mA at 1.8 volts on a power input rail or buss, and another power drawing circuit may be provided with 333 mA at 1.8 volts on another power input rail or buss. In another example, one power drawing circuit may be provided with 500 mA at 1.8 volts on a power input rail or buss, and another power drawing circuit may be provided with 300 mA at 2.0 volts on another power input rail or buss. Internal current I_int may be divided or otherwise apportioned to provide a number of internal voltage inputs replacing what was previously provided by a number of external voltage inputs as illustratively depicted in FIG. 9. However, internal current need not be divided or otherwise apportioned, as a single power source may be use. For purposes of clarity by way of example and not limitation, in an implementation with a single power source, only power source 102-1 associated with a power plane circuit 110 may be used with a single voltage step-down circuit 110-1 for sourcing such power. These are just some of many possible examples.

In any of such implementations, effectively two or more external power pins 11 used for providing a one or more currents in conventional packaged microelectronic device 35 may be replaced with a single external power pin 11, where such single external power pin 11 may be at a same current level I_ext as before for any one of such single external power pins 11 but with a higher external voltage Vext than in such conventional packaged microelectronic device 35. Because external power pins 11, as well as external ground pins 12, may have significantly more restrictive current limits than traces, busses or other wires internal to packaged microelectronic device 35, one or more internal currents sourced from a power plane circuit 110 may exceed a current limit of an external power pin 11.

With continuing reference to FIG. 2-1, positive non-zero voltage or current change factor, $f_{in}$, of less than one may reduce internal voltage according to ($f_{in}$*Vext). Assuming a single internal power source 102-1, then input external power may be generally equal to output internal power from power plane circuit 110 according to P=Vext*I_ext=$P_{out}$=(Vint*$f_{in}$)(I_int/$f_{in}$) ignoring any and all inefficiencies of power plane circuit 110. In other words, as internal voltage Vint is stepped down from an external voltage Vext by a voltage step-down circuit 110-1 by a change factor, $f_{in}$, internal current I_int may be stepped up by a reciprocal of change factor, $f_{in}$, by such a voltage step-down circuit 110-1. As a consequence, the number of external power pins 11 may be reduced compared to a similarly positioned conventional packaged microelectronic device 35.

In another example, more than one internal power source 102 may be used, and thus each individual internal power output may be less than a total internal power output. Moreover, internal current I_int may, but need not, be divided evenly among all internal power sources 102.

At least one internal supply voltage regulator ("IVR") 113 may be coupled to internal power plane circuit 110. In this example, two internal supply voltage regulators 113 are respectively coupled to receive power from internal power sources 102-1 and 102-2. Each internal supply voltage regulator 113 may be configured to regulate an internal supply voltage level Vint of each corresponding internal power source 102 to provide at least one regulated internal supply voltage. In other words, by regulating an internal supply voltage level Vint of an internal power source 102, an internal supply voltage regulator 113 may provide a regulated internal supply voltage Vint to power a circuit portion of die internal "core logic" circuitry ("circuitry") 114 or other die internal circuitry. In another implementation, internal supply voltage regulators 113 may provide one or more stepped down voltages in place of corresponding voltage step-down circuits 110-1 and 110-2 of power plane circuit 110. In yet another implementation, internal supply voltage regulators 113 or other voltage regulation circuitry may be incorporated into power plane circuit 110, and such internal supply voltage regulators 113 or other step-down circuitry may provide voltage step down for power plane circuit 110. Thus, even though a regulated internal supply voltage Vint is described, there may be same or different values for a regulated internal supply voltage Vint output from an IVR 113.

One or more voltages output from each of internal supply voltage regulators 113 may be provided to circuitry 114, such as may be instantiated in an FPGA, ASIC or other IC. Circuitry 114 may be coupled to external ground pins 12, which external ground pins 12 may be commonly coupled to an earth or other zero volts ground ("GND") 104. Though two external ground pins 12 are illustratively depicted, in another example more than two external ground pins 12 may be used.

In the example of FIG. 2-1, power plane circuit 110 configured to step down voltage Vext to Vint is in a separate integrated circuit ("IC") die 111 from an IC die 112 of a packaged microelectronic device 100. IC die 112 includes internal supply voltage regulators 113 and circuitry 114, as well as couplings of circuitry 114 to external ground pins 12. Single instances of each of IC dies 111 and 112 are illustratively depicted, though in another implementation multiple instances of either or both of IC dies 111 and 112 may be of a packaged microelectronic device 100. Circuitry of IC die 112 may still include conventional power and/or ground pins, such as for example power pins 11 for one or more of VRATT, VCC AUX_IO, VCC AUX, VCCDRAM, VCC ADC, MGT AVCC, MGT AVTT, VCC INT, VCC BRAM and MGT VCC AUX and/or ground pins for one or more of a ground for an analog-to-digital converter ("ADC"), namely GNDADC which is less noisy than a conventional ground.

Even though one external power pin 11 coupled to a power plane circuit 110 is illustratively depicted, in another example more than one external power pin 11 may be coupled to a power plane circuit 110 for providing more current on an internal output side of such power plane circuit, as generally indicated by ellipses. In this example implementation, two pins 11 at Vext and I_ext may be used to replace more than two pins 11 having previously been used for some voltage and current levels, such as for example conventional external voltage and current levels. Even though separate IC dies 111 and 112 are illustratively depicted, in another implementation a same IC die 105 may include power plane circuit 110 and internal supply voltage regulators 113, and may further include circuitry 114.

FIG. 2-2 is a block diagram illustratively depicting another exemplary packaged microelectronic device 100. Microelectronic device 100 of FIG. 2-2 is the same as that of FIG. 2-1, except for the following differences. In FIG. 2-2, an external reference input voltage 145 and an external reference ground voltage 144 are used for biasing power plane circuit 110 in contrast to internal reference input voltage 145 and internal reference ground voltage 144 illustratively depicted in FIG. 2-1.

In microelectronic device 100 of FIG. 2-2, there are two IC dies 112, namely IC die 112-1 and IC die 112-2. IC die 112-1 includes at least one internal supply voltage regulator 113 coupled to circuitry 114-1, namely a portion of circuitry 114, 114. Likewise, IC die 112-2 includes at least one internal supply voltage regulator 113 coupled to circuitry 114-2, namely another portion of circuitry 114. Power plane circuit 110 of IC die 111 is coupled as previously described though to one internal supply voltage regulator 113 of IC die 112-1 and to one internal supply voltage regulator 113 of IC die 112-2.

Circuitry 114-1 is coupled to at least one external ground pin 12, and circuitry 114-2 is coupled to at least one other external ground pin 12. Such external ground pins 12 may be commonly coupled to a ground 104, as previously described. Moreover, there may be one or more instances of either or both IC dies 112-1 and/or 112-2. In this configuration, a portion of circuitry 114 may be more readily unpowered in order to save power.

Figures 2, 3:
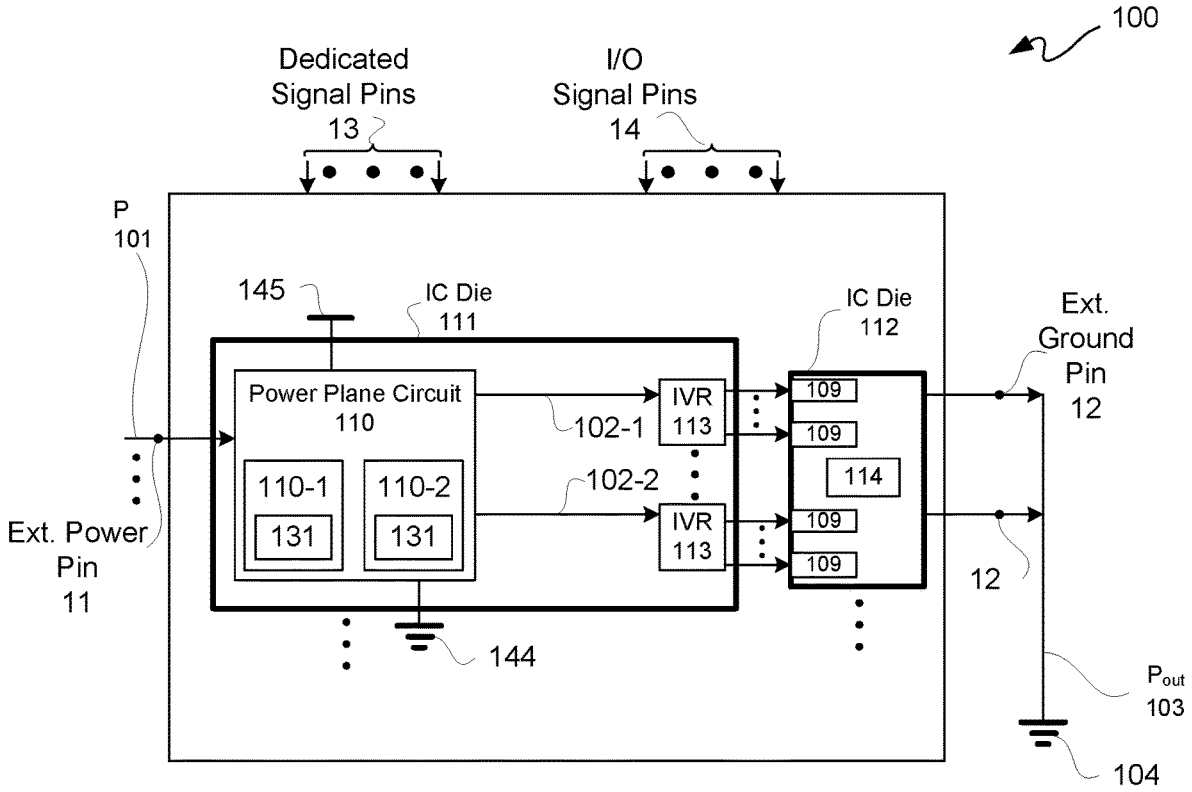
Figures 1, 3:
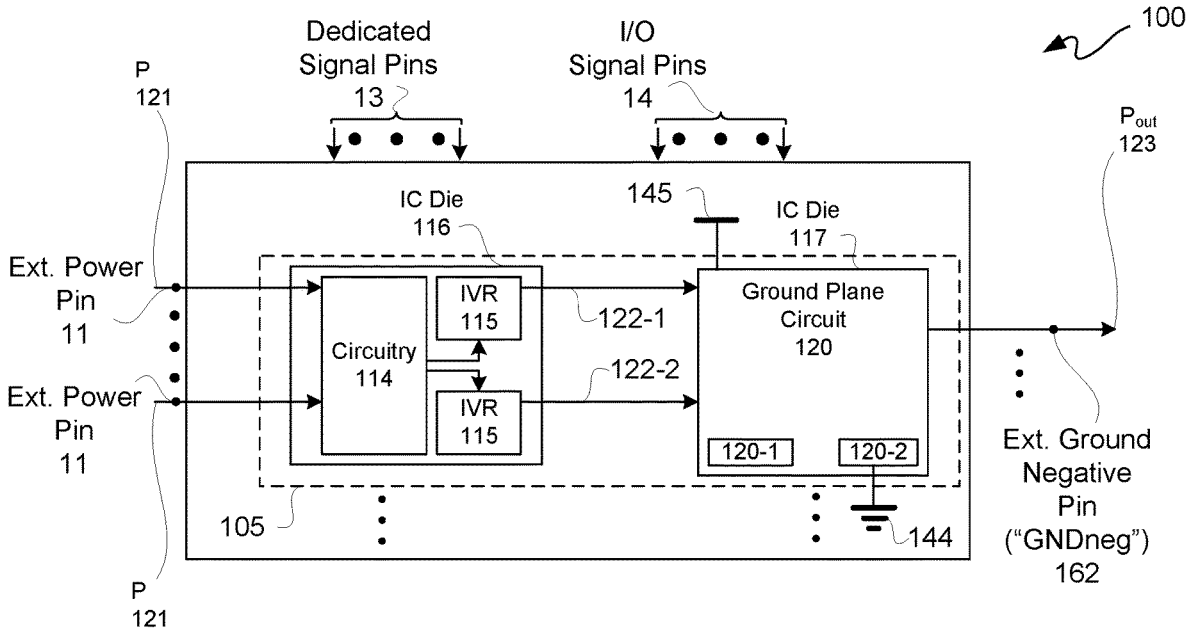
Figures 2, 3:
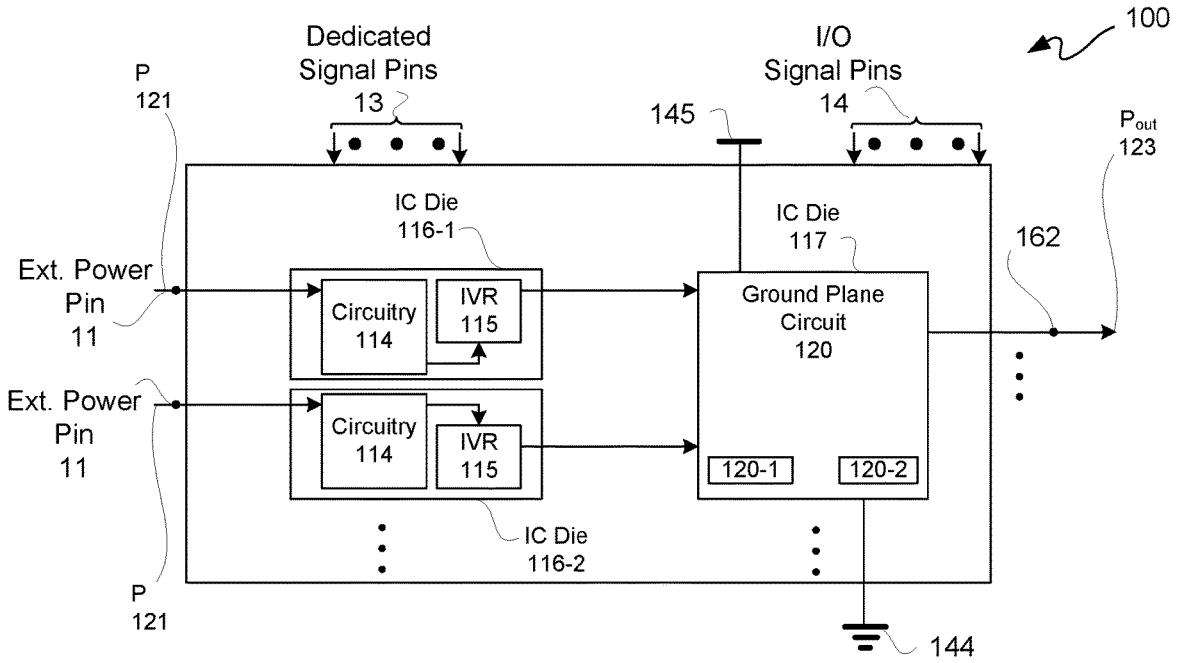

FIG. 2-3 is a block diagram illustratively depicting yet another exemplary packaged microelectronic device 100. Microelectronic device 100 of FIG. 2-3 is the same as that of FIG. 2-1, except for the following differences. IC die 111 includes both power plane circuit 110 and internal supply voltage regulators 113. Along those lines, multiple different voltages may be generated internally by internal supply voltage regulators 113 from an externally provided input external voltage Vext. These internal supply voltage regulators 113 may be implemented in multiple locations inside a packaged microelectronic device 100, and voltages generated by such internal supply voltage regulators 113 may be routed to power pins of one or more IC dies 112 within a packaged microelectronic device 100, including without limitation bypass capacitors 109 of one or more IC dies 112 within a packaged microelectronic device 100.

Without wishing to be bound by theory, it is generally believed that the amount of electrons or charge into a device equals the amount of electrons or charge out of a device. However, conventionally output voltage has been set to a zero volt ground voltage level for ICs, which limits flow of electrons or charge out of a device. Moreover, because external ground pins 12 are current limited, such current limit imposes another limit on flow of charge out of a device.

FIG. 3-1 is a block diagram illustratively depicting yet another exemplary packaged microelectronic device 100. Input power ("P") 121 may be provided to microelectronic device 100 via two or more external power pins 11. In this example, each input power, P 121, is equal to a conventional input external current I_ext level multiplied with a conventional input external voltage level, where each conventional input current I_ext level is limited by a current limit of each of external power input supply pins 11.

Power output generally equals power input, minus power lost to heat. So the current on ground pins generally equals the current on corresponding input pins. However, in FIG. 3-1, an external output ("GNDneg") is tied to a negative voltage level, for example −2 V, below a ground level of IC die 117. Thus, current on negative-tied ground pin ("negative ground pin") 162 is lower than it would be if GNDneg were 0 volts, namely a GND. Negative ground pin 162 may be the same configuration as a ground pin 12, but tied to a negative external voltage level as described herein, and so for purposes of clarity only a separate reference number is used for a negative-tied ground pin 162 as compared with a zero volts-tied ground pin 12. A voltage difference across negative ground pin 162 may be reduced by a voltage reduction factor $f_{out}$=(Vint−GNDneg)/Vint. Recall that GNDneg is a negative voltage, and generally GNDneg may be −1 volt or lower than a ground voltage level.

By having more voltage overhead on a ground side of a microelectronic device 100, less current may be used across associated negative ground pins 162. In other words, by having a greater voltage spread, an amount of current to be output across one or more negative ground pins 162 may be reduced. For a same output power level as a conventional output power level, voltage magnitude may be increased while inversely reducing output current to provide a same amount of charge flow.

By reducing current, one or more voltage drop inside a packaged device may be reduced by passing less current downstream on traces, busses or other wires directly coupled to external ground pins 12 according to voltage equal to current multiplied by resistance or V=IR, and so less current may mean less voltage drop inside a packaged device. Therefore, generally a same amount of power may be output with less current resulting in less IR loss and/or less IR heating. Optionally, this may mean that size of negative ground pins 162 may be reduced, so as to have a lower maximum current than a conventional ground pin 12.

Regardless of the aforementioned benefits, a benefit that cannot be overlooked is that a number of external negative ground pins 162 of a microelectronic device 100 may be reduced in comparison to using conventional ground pins 12. In other words, rather than having a number of same ground voltages output through a number of different external ground pins 12, such number of external ground pins 12 may be replaced by a single external negative ground pin 162 associated with one or more internal ground sinks. A greater magnitude output voltage though more negative than a zero ground voltage may be used. A ground plane circuit 120 may be used for stepping one or more zero volt ground voltages down to such negative output voltage internally within such microelectronic device 100, as well as a corresponding stepped reduction in current level.

Arrows in FIG. 3-1 indicate a general direction of current flow. By reducing a number of external conventional ground pins 12 in favor of fewer negative ground pins 162, more pins may be reallocated for having more dedicated pins 13 and/or I/O pins 14, and/or by reducing size of external negative ground pins 162, more pins may be opened up for having more dedicated pins 13 and/or I/O pins 14 as compared to a conventional packaged microelectronic device 35. Optionally, packaged microelectronic device 100 may provide same functionality as a similarly positioned device though with using fewer external power pins 11 and/or fewer external ground pins 12.

In FIG. 3-1, an external negative ground pin 162 may be configured for receiving an output ground-side power 123 having an external output voltage level of GNDneg. For purposes of clarity by way of example and not limitation, it shall be assumed that external output voltage level of GNDneg is −2 volts. Such an external negative ground pin 162 may have an output current limit. An output ground-side power $P_{out}$ may be equal to or at least approximately equal to such external output voltage level GNDneg multiplied by an output current I_out, which may be at such an output current limit. Because GNDneg is a negative value, generally a voltage level lower than a ground reference, output power may have a negative value.

A ground plane circuit 120 internal to microelectronic device 100 may be coupled to external negative ground pin 162 and may be configured to step-down voltage from an internal ground level ("Vgnd") from at least one internal ground sink 122 to an external negative sink voltage level GNDneg coupled to an external negative ground pin 162. Ground plane circuit 120 may be coupled to a reference input voltage 145 and/or a reference ground voltage 144 to provide reference levels for voltage step down. In this example, ground plane circuit 120 is configured to convert voltage levels of two internal ground sinks 122-1 and 122-2, though in another example one, or more than two, internal ground sinks 122 may be coupled to ground plane circuit 120.

External negative ground pin 162 by being tied to a negative sink voltage level GNDneg allows for internal current I_int input to ground plane circuit 120 to exceed a maximum current limit of negative ground pin 162. In other words, one or more internal currents may exceed a current limit of an external negative ground pin 162; however, these one or more internal currents are adjusted down for output on external negative ground pin 162 without exceeding such current limit thereof. Correspondingly, magnitude of voltage is adjusted up for having sufficient charge flow on external negative ground pin 162. By having a GNDneg, more charge may be output on a single negative ground pin 162 to avoid having to have multiple external ground pins 12, such as in conventional packaged microelectronic device 35, for output of charge from one or more instances of I_ext input via external power pins 11 used to provide one or more instances of internal current I_int. As the convention of current flow is positive charges going from a higher to lower potential, it shall be assumed that output current I_out flows from Vgnd to GNDneg, which may or may not be the directionality of flow of actual charges, electrons and ions.

An external negative sink voltage level GNDneg may be at least one volt below a ground voltage level, namely a potential difference of at least one volt in a negative direction. Ground plane circuit 120 may include one or more voltage step down circuits, such as voltage step down circuits 120-1 and 120-2 for example, for stepping down voltage from an internal ground level Vgnd from one or more internal ground sinks 122 to an external negative sink voltage level GNDneg coupled to an external negative ground pin 162. Internal ground level Vgnd may be one or more same or different conventional internal ground voltage levels, which conventionally are all zero volts.

In another implementation, where internal ground voltage regulators 115 do not have a separate ground reference, but rather depend upon ground plane circuit 120 for providing a ground reference, ground plane circuit 120 may be coupled to one or more corresponding internal ground sinks 122, such as for example internal ground sinks 122-1 and 122-2. Ground plane circuit 120 may be configured for stepping up from a negative output voltage level, GNDneg, to one or more ground level Vgnd voltages. Such one or more ground level voltages may correspond to one or more internal ground sinks 122, such as for example one or more of internal ground sinks 122-1 and 122-2. Such adjustment in voltage includes a corresponding decrease in amperage in output current level I_out. Along those lines, $P_{out}$ may be thought of as an input power $P_{in}$ with the direction of the arrow of $P_{out}$ reversed. However, for purposes of clarity by way of example and not limitation, the convention of $P_{out}$ is used. Moreover, for purposes of clarity by way of example and not limitation, with reference to FIGS. 3-1 and 3-2, it shall be assumed that ground plane circuit 120 is configured for stepping down voltages Vgnd on internal ground sinks 122-1 and 122-2 to a negative output voltage level of GNDneg, even though in another example one or more than two internal ground sinks may be implemented.

Conceptually ground plane circuit 120 may be thought of as converting external ground connections to an internal ground plane, and coupling a resistor and capacitor circuit to such internal ground plane for stepping down voltage to a negative output voltage provided to such ground plane circuit 120 via an external negative ground pin 162. By having a negative output voltage, more charge with less or equivalent current may be provided than using a zero volt ground at an external ground pin 12. In other words, charge of internal ground plane circuit 120 is dissipated at a negative output voltage of GNDneg in order to have output current I_out be sufficiently less to pass on a single, or at least fewer, external ground pins 162 than dissipating a same amount of charge on more instances of conventional zero volts external ground pins 12.

Input power P 121 may be respectively provided to one or more external input power pins 11 to provide power to circuitry 114, such as may be instantiated in an FPGA or other IC. In other words, external current I_ext may effectively be internal current I_int, and there may in effect be multiple instances of I_int provided using multiple instances of input power pins 11. Circuitry 114 may be coupled to one or more internal ground voltage regulators 115. Internal ground voltage regulators 115 may be coupled to internal ground nodes or internal ground sinks 122-1 and 122-2 for respectively receiving output powers, namely charge to be output from microelectronic device 100. Circuitry of IC die 116 may still include conventional power and/or ground pins, such as for example power pins 11 for one or more of VRATT, VCC AUX_IO, VCC AUX, VCCDRAM, VCC ADC, MGT AVCC, MGT AVTT, VCC INT, VCC BRAM and MGT VCC AUX and/or ground pins for one or more of a ground for an analog-to-digital converter ("ADC"), namely GNDADC which is less noisy than a conventional ground.

At least one internal ground voltage regulator 115 may be coupled to internal ground plane circuit 120. In this example, two internal ground voltage regulators 115 are respectively coupled to respectively provide output power onto internal ground sinks 122-1 and 122-2. Each internal ground voltage regulator 115 may be configured regulate an internal ground voltage level for circuitry 114 to provide a corresponding regulated internal ground voltage reference. In other words, by regulating an internal ground voltage level Vgnd for an internal ground sink 122, an internal ground voltage regulator 115 may provide a regulated ground voltage Vgnd for a core logic portion of circuitry 114 or other circuitry.

An internal ground voltage Vgnd from each of internal ground voltage regulators 115 may be provided with an internal current I_int. Ground plane circuit 120 may be coupled to such internal ground sinks 122-1 and 122-2 and may be configured for stepping down such voltages on internal ground sinks 122-1 and 122-2 to a negative output voltage level GNDneg, along with a corresponding decreased amperage in output current level I_out. In other words, an output current I_out may have significantly less amps than one or more instances of conventional internal current level I_int. In some implementations, internal ground traces, busses or other wires may be shorted together, as such internal wiring is capable of handling higher amperage levels than external pins.

In another implementation, where internal ground voltage regulators 115 do not have a separate ground reference, but rather depend upon ground plane circuit 120 for providing a ground reference, ground plane circuit 120 may be coupled to such internal ground sinks 122-1 and 122-2 and may be configured for stepping up a negative output voltage level GNDneg to one or more ground level voltages on internal ground sinks 122-1 and 122-2, along with a corresponding decreased charge in output current level I_out. Again, for purposes of clarity by way of example and not limitation, it shall be assumed that ground plane circuit 120 is configured for stepping down such voltages on internal ground sinks 122-1 and 122-2 to a negative output voltage level GNDneg.

Ground plane circuit 120 may be coupled to an external negative ground pin 162, which external negative ground pin 162 may be coupled to a negative voltage supply (not shown). Ground plane circuit 120 may provide output power or charge to external negative ground pin 162, where such total external output ground-side power $P_{out}$ 123 can be estimated as I_out(Vint−GNDneg). In some implementations, output current I_out may be less than one or more instances of an internal current level I_int, and so optionally size of external ground pins 162 may correspondingly be reduced.

In the example of FIG. 3-1, ground plane circuit 120, configured to step down voltage from Vgnd to GNDneg, is in a separate IC die 117 from an IC die 116 of a packaged microelectronic device 100. IC die 116 includes internal ground voltage regulators 115 and circuitry 114, as well as couplings of circuitry 114 to external power pins 11. Single instances of each of IC dies 116 and 117 are illustratively depicted, though in another implementation multiple instances of either or both of IC dies 116 and 117 may be of a packaged microelectronic device 100. Furthermore, even though one external negative ground pin 162 coupled to a ground plane circuit 120 is illustratively depicted, in another example more than one external negative ground pin 162 may be coupled to a ground plane circuit 120 for providing more charge throughput on an internal output side of such ground plane circuit. Furthermore, even though separate IC dies 116 and 117 are illustratively depicted, in another implementation a same IC die 105 may include ground plane circuit 120 and internal ground voltage regulators 115, and may further include circuitry 114.

FIG. 3-2 is a block diagram illustratively depicting still yet another exemplary packaged microelectronic device 100. Microelectronic device 100 of FIG. 3-2 is the same as that of FIG. 3-1, except for the following differences. In FIG. 3-2, an external reference input voltage 145 and an external reference ground voltage 144 are used for biasing ground plane circuit 120 in contrast to internal reference input voltage 145 and internal reference ground voltage 144 illustratively depicted in FIG. 3-1.

In microelectronic device 100 of FIG. 3-2, there are two IC dies 116, namely IC die 116-1 and IC die 116-2. IC die 116-1 includes at least one internal ground voltage regulator ("IVR") 115 coupled to a portion of circuitry 114, namely circuitry 114-1. Likewise, IC die 112-2 includes at least one other internal ground voltage regulator ("IVR") 115 coupled to another portion of circuitry 114, namely circuitry 114-2. IVRs 115 of IC dies 116-1 and 116-2 are respectively coupled to ground plane circuit 120 of IC die 117. Ground plane circuit 120 is coupled to at least one external negative ground pin 162. Moreover, there may be one or more instances of either or both IC dies 116-1 and/or 116-2 in a microelectronic device 100, and one or more instances of IC die 117 in a microelectronic device 100. In this configuration, a portion of circuitry 114 may be more readily unpowered in order to save power.

Figure 4:
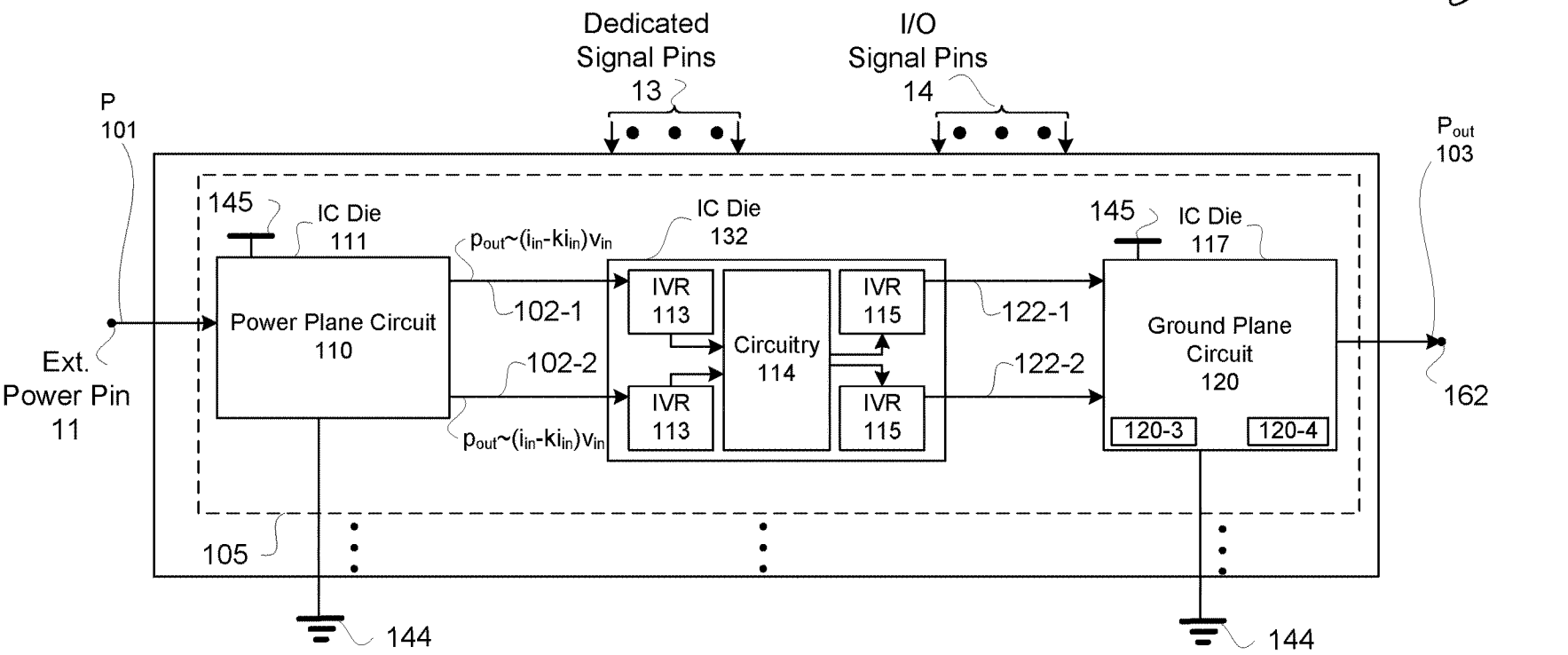
FIG. 4 is a block diagram depicting still yet further another exemplary packaged microelectronic device.

FIG. 4 is a block diagram illustratively depicting still yet further another exemplary packaged microelectronic device 100. Microelectronic device 100 of FIG. 4 is a combination of microelectronic devices of FIGS. 2-1 and 3-1, and so generally same description is not repeated for purposes of clarity and not limitation. In FIG. 4, an internal reference input voltage 145 and an external reference ground voltage 144 are used for biasing power plane circuit 110 and ground plane circuit 120.

Coupled between power plane circuit 110 of IC die 111 and ground plane circuit 120 of IC die 117 is an IC die 132. IC die 132 includes power supply-side internal supply voltage regulators 113, circuitry 114, and ground sink-side internal ground voltage regulators 115.

Internal supply voltage regulators 113 are respectively coupled to internal power sources 102-1 and 102-2, as previously described, and internal ground voltage regulators 115 are respectively coupled to internal ground sinks 122-1 and 122-2, as previously described. Internal supply voltage regulators 113 are coupled to provide regulated supply-side power voltages to circuitry 114, and internal ground voltage regulators 115 are coupled to provide regulated sink-side ground voltages to circuitry 114. Optionally, IC dies 111, 117, and 132 may be formed as a single IC die 105. Furthermore, package microelectronic device 100 may include one or more instances of one or more of IC dies 111, 117, and/or 132, or IC die 105. By using both power plane circuit 110 and ground plane circuit 120 in a same microelectronic device 100, a reduction in both external power pins and external ground pins may be achieved for reasons as previously described herein.

In this example implementation, internal ground voltage regulators 115 do not have a separate ground reference, but rather depend upon ground plane circuit 120 for providing a ground reference. Ground plane circuit 120 may be coupled to such internal ground sinks 122-1 and 122-2 and may be configured for stepping up from a negative output voltage level GNDneg to one or more ground level voltages on internal ground sinks 122-1 and 122-2, along with a corresponding decreased output current in output current level I_out. Because an external supply current level for I_ext is at or less than a maximum current level of a power input pin 11, and because power input pins 11 and negative ground pins 162 may have same or similar maximum current levels, ground plane 120 may be configured to step-down I_int to I_out, where I_out may be approximately at a same current level of I_ext used to source I_int.

Ground plane circuit 120 may include one or more voltage step-up circuits, such as voltage step-up circuits 120-3 and 120-4 for example, for stepping up voltage to an internal ground level Vgnd on one or more internal ground sinks 122 from an external negative sink voltage level GNDneg coupled to an external negative ground pin 162. Internal ground level of Vgnd may be one or more same or different conventional internal output or ground voltage levels to provide to one or more internal ground sinks 122. However, in another implementation of microelectronic device 100 of FIG. 4, ground plane circuit 120 may be configured for stepping down such voltages on internal ground sinks 122-1 and 122-2 to a negative output voltage level GNDneg such as previously described.

Figure 5:
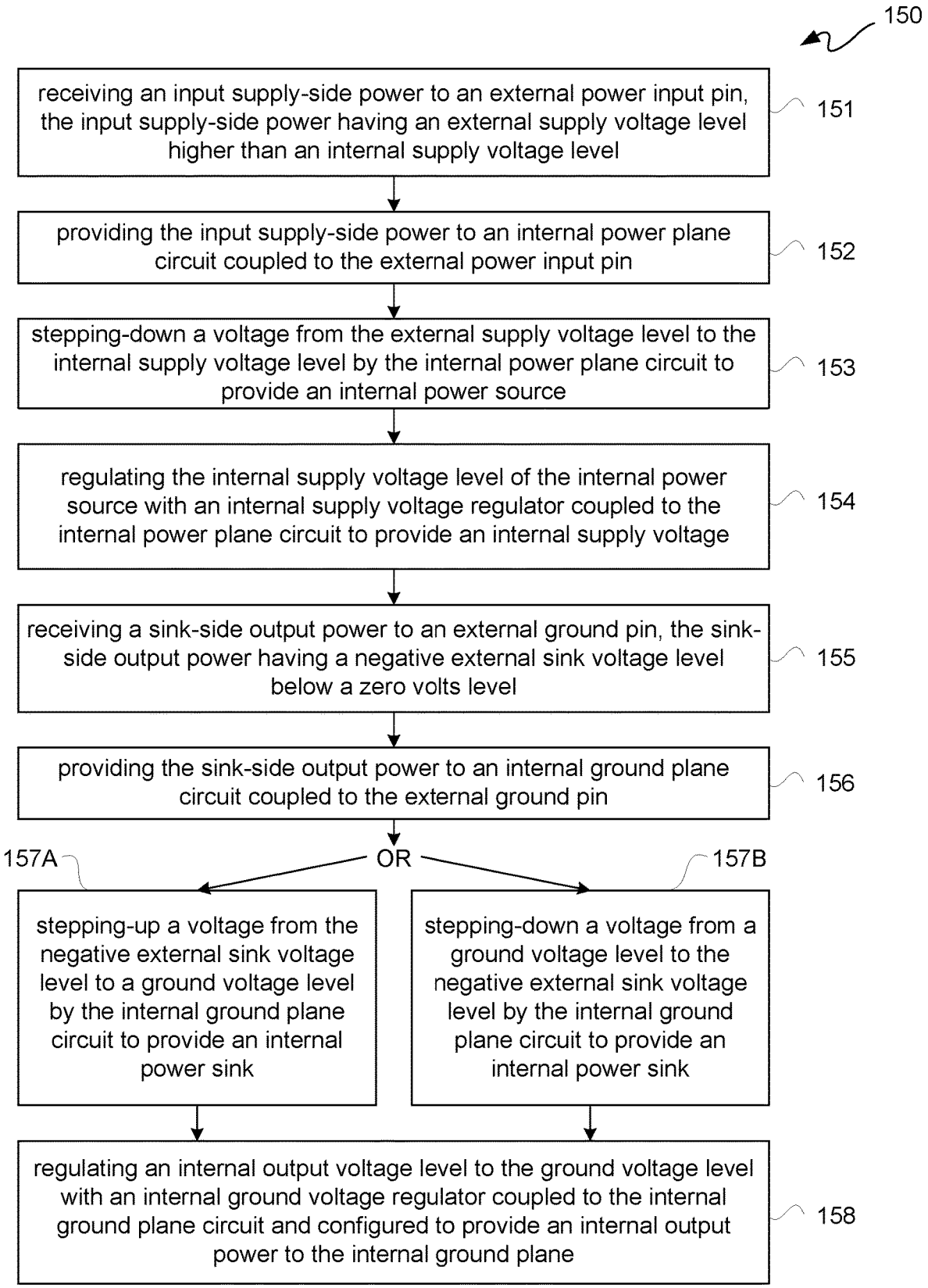
FIG. 5 is a flow diagram depicting an exemplary power system regulation flow for a packaged microelectronic device(s) of FIGS. 2-1 through 4.

FIG. 5 is a flow diagram illustratively depicting an exemplary power system regulation flow 150 for a packaged microelectronic device 100 of FIGS. 2-1 through 4. Power system regulation flow 150 is further described with simultaneous reference to FIGS. 2-1 through 5.

At 151, an input supply-side power may be received to an external power input pin 11. Such input supply-side power may have an external supply voltage level higher than a corresponding internal supply voltage level. Such input supply-side power may be provided at 152 to an internal power plane circuit 110 coupled to such external power input pin 11. At 153, voltage may be stepped-down from such an external supply voltage level to such an internal supply voltage level by internal power plane circuit 110 to provide an internal power source 102. At 154, such internal supply voltage level of such internal power source 102 may be regulated with an internal supply voltage regulator 113 coupled to internal power plane circuit 110 to provide an internal supply voltage.

At 155, a sink-side output power may be received to an external ground pin 162. Such sink-side output power may have a negative external sink voltage level below a zero volts level. External pins 11 and 12 may have a same or different current limit. At 156, sink-side output power may be provided to an internal ground plane circuit 120 coupled to external negative ground pin 162.

Either a step-up voltage operation at 157A or a step-down voltage operation at 157B may be performed following operation 156. At 157A, voltage from such negative external sink voltage level may be stepped up to a ground voltage level by internal ground plane circuit 120 to provide an internal ground sink 122. At 157B, voltage from a ground voltage level may be stepped down to such negative external sink voltage level by internal ground plane circuit 120 to provide an internal ground sink 122. Following either stepping up at 157A or stepping down at 157B, at 158 an internal output voltage level may be regulated to such ground voltage level with an internal ground voltage regulator 115 coupled to internal ground plane circuit 120 and configured to provide an internal output power to internal ground plane circuit 120.

Because one or more of the examples described herein may be implemented in an FPGA, a detailed description of such an IC is provided. However, it should be understood that other types of ICs may benefit from the technology described herein.

Programmable logic devices ("PLDs") are a well-known type of integrated circuit that can be programmed to perform specified logic functions. One type of PLD, the field programmable gate array ("FPGA"), typically includes an array of programmable tiles. These programmable tiles can include, for example, input/output blocks ("IOBs"), configurable logic blocks ("CLBs"), dedicated random access memory blocks ("BRAMs"), multipliers, digital signal processing blocks ("DSPs"), processors, clock managers, delay lock loops ("DLLs"), and so forth. As used herein, "include" and "including" mean including without limitation.

Each programmable tile typically includes both programmable interconnect and programmable logic. The programmable interconnect typically includes a large number of interconnect lines of varying lengths interconnected by programmable interconnect points ("PIPs"). The programmable logic implements the logic of a user design using programmable elements that can include, for example, function generators, registers, arithmetic logic, and so forth.

The programmable interconnect and programmable logic are typically programmed by loading a stream of configuration data into internal configuration memory cells that define how the programmable elements are configured. The configuration data can be read from memory (e.g., from an external PROM) or written into the FPGA by an external device. The collective states of the individual memory cells then determine the function of the FPGA.

Another type of PLD is the Complex Programmable Logic Device, or CPLD. A CPLD includes two or more "function blocks" connected together and to input/output ("I/O") resources by an interconnect switch matrix. Each function block of the CPLD includes a two-level AND/OR structure similar to those used in Programmable Logic Arrays ("PLAs") and Programmable Array Logic ("PAL") devices. In CPLDs, configuration data is typically stored on-chip in non-volatile memory. In some CPLDs, configuration data is stored on-chip in non-volatile memory, then downloaded to volatile memory as part of an initial configuration (programming) sequence.

For all of these programmable logic devices ("PLDs"), the functionality of the device is controlled by data bits provided to the device for that purpose. The data bits can be stored in volatile memory (e.g., static memory cells, as in FPGAs and some CPLDs), in non-volatile memory (e.g., FLASH memory, as in some CPLDs), or in any other type of memory cell.

Other PLDs are programmed by applying a processing layer, such as a metal layer, that programmably interconnects the various elements on the device. These PLDs are known as mask programmable devices. PLDs can also be implemented in other ways, e.g., using fuse or antifuse technology. The terms "PLD" and "programmable logic device" include but are not limited to these exemplary devices, as well as encompassing devices that are only partially programmable. For example, one type of PLD includes a combination of hard-coded transistor logic and a programmable switch fabric that programmably interconnects the hard-coded transistor logic.

Figure 6:
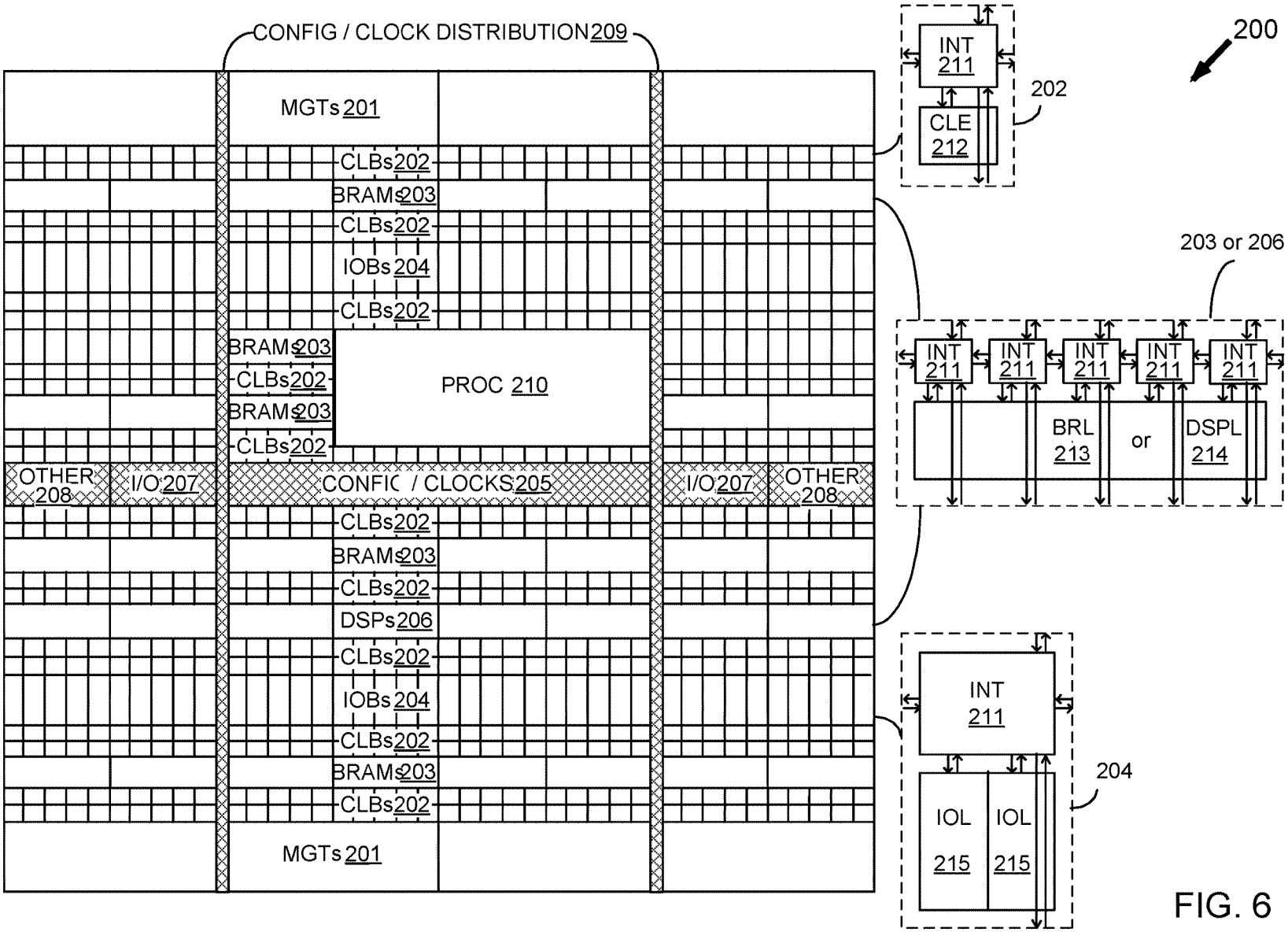
FIG. 6 is a simplified block diagram depicting an exemplary columnar Field Programmable Gate Array ("FPGA") architecture.

As noted above, advanced FPGAs can include several different types of programmable logic blocks in the array. For example, FIG. 6 illustrates an FPGA architecture 200 that includes a large number of different programmable tiles including multi-gigabit transceivers ("MGTs") 201, configurable logic blocks ("CLBs") 202, random access memory blocks ("BRAMs") 203, input/output blocks ("IOBs") 204, configuration and clocking logic ("CONFIG/CLOCKS") 205, digital signal processing blocks ("DSPs")

206, specialized input/output blocks ("I/O") 207 (e.g., configuration ports and clock ports), and other programmable logic 208 such as digital clock managers, analog-to-digital converters, system monitoring logic, and so forth. Some FPGAs also include dedicated processor blocks ("PROC") 210.

In some FPGAs, each programmable tile includes a programmable interconnect element ("INT") 211 having standardized connections to and from a corresponding interconnect element in each adjacent tile. Therefore, the programmable interconnect elements taken together implement the programmable interconnect structure for the illustrated FPGA. The programmable interconnect element 211 also includes the connections to and from the programmable logic element within the same tile, as shown by the examples included at the top of FIG. 6.

For example, a CLB 202 can include a configurable logic element ("CLE") 212 that can be programmed to implement user logic plus a single programmable interconnect element ("INT") 211. A BRAM 203 can include a BRAM logic element ("BRL") 213 in addition to one or more programmable interconnect elements. Typically, the number of interconnect elements included in a tile depends on the height of the tile. In the pictured implementation, a BRAM tile has the same height as five CLBs, but other numbers (e.g., four) can also be used. A DSP tile 206 can include a DSP logic element ("DSPL") 214 in addition to an appropriate number of programmable interconnect elements. An 10B 204 can include, for example, two instances of an input/output logic element ("IOL") 215 in addition to one instance of the programmable interconnect element 211. As will be clear to those of skill in the art, the actual I/O pads connected, for example, to the I/O logic element 215 typically are not confined to the area of the input/output logic element 215.

In the pictured implementation, a horizontal area near the center of the die (shown in FIG. 6) is used for configuration, clock, and other control logic. Vertical columns 209 extending from this horizontal area or column are used to distribute the clocks and configuration signals across the breadth of the FPGA.

Some FPGAs utilizing the architecture illustrated in FIG. 6 include additional logic blocks that disrupt the regular columnar structure making up a large part of the FPGA. The additional logic blocks can be programmable blocks and/or dedicated logic. For example, processor block 210 spans several columns of CLBs and BRAMs.

Note that FIG. 6 is intended to illustrate only an exemplary FPGA architecture. For example, the numbers of logic blocks in a row, the relative width of the rows, the number and order of rows, the types of logic blocks included in the rows, the relative sizes of the logic blocks, and the interconnect/logic implementations included at the top of FIG. 6 are purely exemplary. For example, in an actual FPGA more than one adjacent row of CLBs is typically included wherever the CLBs appear, to facilitate the efficient implementation of user logic, but the number of adjacent CLB rows varies with the overall size of the FPGA.

Figure 7:
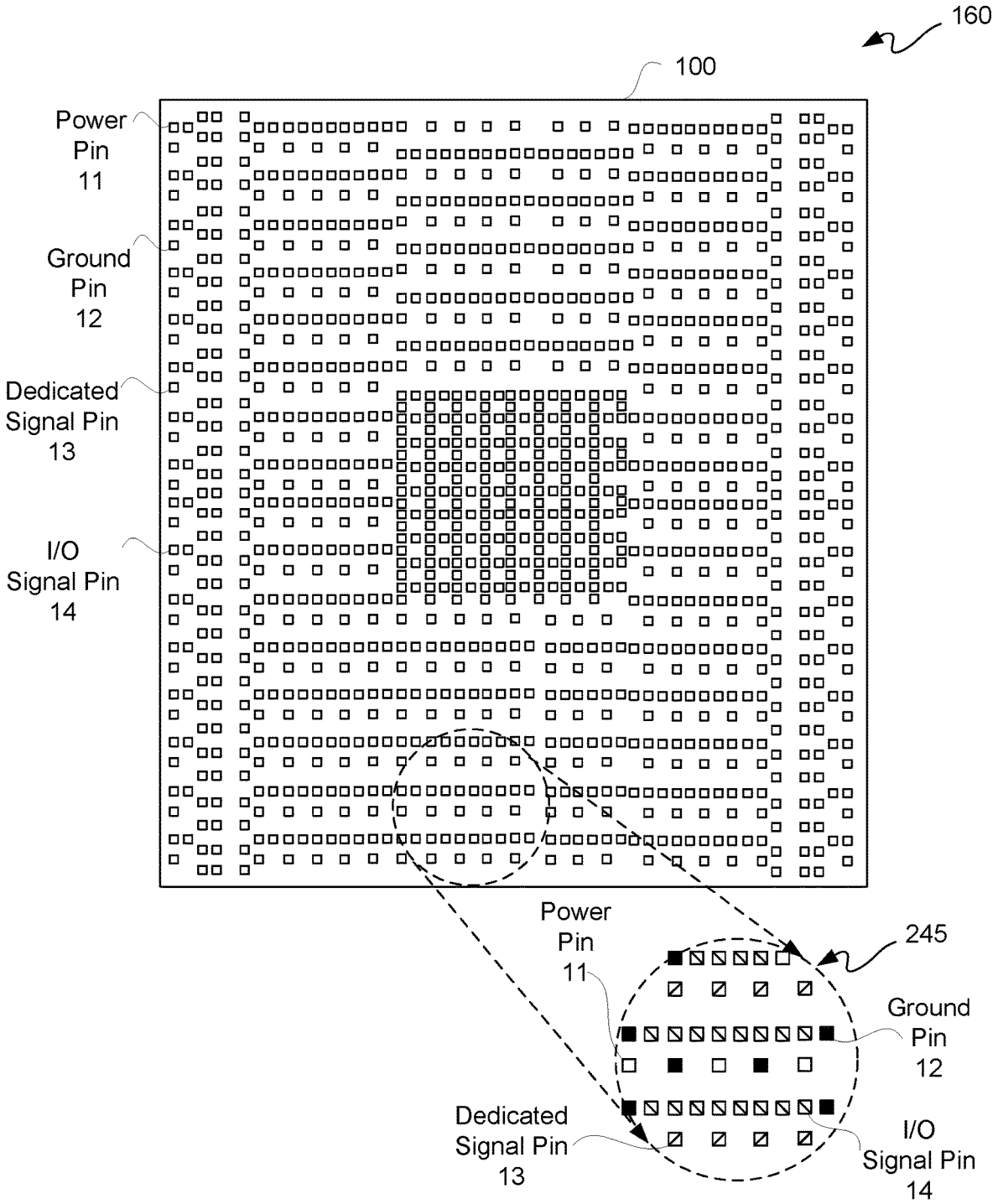
FIG. 7 is a block diagram depicting an exemplary pinout of a microelectronic device.

FIG. 7 is a block diagram illustratively depicting an exemplary pinout 160 of a microelectronic device 100. Pinout 160 of microelectronic device 100 is pinout 20 of FIG. 1 after removing approximately 25% of pins thereof. Even approximately a 25% reduction in pin allocation to power pins 11 and/or ground pins 12 can make a significant impact on density of pins in pinout 160 in comparison to pinout 20. At least some of external ground pins 12 may be coupled to GNDneg, and thus may be considered external ground pins 162. However, some of external ground pins 12 may be coupled to a conventional ground voltage level. However, for purposes of clarity and not limitation, all external ground pins are referred to as ground pins 12 even though some may be coupled to GNDneg while others are coupled to GND.

While power pins 11 and/or ground pins 12 may be removed in accordance with using power and/or ground plane circuits, respectively, as described herein to reduce packaging costs associated with high pin counts, such pins may in other implementations remain. Pins of pinout 160 need not be physically removed for reduction of pins for a power system. With respect to leaving such pins in place, such power pins 11 and/or ground pins 12 which may be "removed" from a power regulation system may be reallocated, and thus rewired for other purposes, such as to provide additional dedicated pins 13 or I/O pins 14. By having additional control and/or data signals to and/or from a microelectronic device 100, additional functionalities, reduction in data rate or other speed parameters, less internal clock distribution routing, and/or other features and/or benefits may be obtained.

For purposes of clarity by way of example and not limitation, enlarged circular area 245 illustratively depicts external power pins 11 as unfilled boxes, external ground pins 12 as filled boxes, dedicated pins 13 as boxes with slashes, and I/O pins 14 as boxes with back slashes. Of course, actual pin allocation will vary from packaged microelectronic device-to-packaged microelectronic device, and pins in this FIG. 7 are for purposes of illustration only not representing an actual implementation of a pinout. Again, while this is embodiment represents a removal of power and ground pins, in another implementation a reallocation without removal of pins may be used in accordance with the above description, and in yet another implementation a combination of reallocation and removal of pins may be used in accordance with the above description.

While the foregoing describes exemplary apparatus(es) and/or method(s), other and further examples in accordance with the one or more aspects described herein may be devised without departing from the scope hereof, which is determined by the claims that follow and equivalents thereof. Claims listing steps do not imply any order of the steps. Trademarks are the property of their respective owners.

What is claimed is:

1. A microelectronic device, comprising:

an external power input pin configured for receiving an input supply-side power, the input supply-side power having an external supply voltage level;

an external ground pin configured for receiving a sink-side output power having a negative external sink voltage level;

an internal power plane circuit coupled to the external power input pin, the internal power plane circuit being configured to provide internal power sources, the internal power plane circuit comprising a voltage converter configured to step-down a voltage from the external supply voltage level to, for each internal power source, a respective first internal supply voltage level that is lower than the external supply voltage level;

an internal ground plane circuit coupled to the external ground pin and configured to step-up a voltage from the negative external sink voltage level to a ground voltage level that is higher than the negative external sink voltage level;

internal supply voltage regulators coupled to the internal power plane circuit, the internal supply voltage regulators being configured to receive the internal power sources from the internal power plane circuit, each of the internal supply voltage regulators being configured to provide a respective second internal supply voltage by regulating the respective first internal supply voltage level of the internal power sources; and an internal ground voltage regulator coupled to the internal ground plane circuit, the internal ground voltage regulator being configured to provide an internal output power to the internal ground plane circuit by regulating an internal output voltage level to the ground voltage level.

2. The microelectronic device according to claim 1, wherein the input supply-side power is equal to the external supply voltage level multiplied by an external supply current level of the input supply-side power at an input current limit of the external power input pin.

3. The microelectronic device according to claim 1, further comprising:

a first integrated circuit die and a second integrated circuit die physically separate from the first integrated circuit die; and wherein the internal power plane circuit and the internal supply voltage regulators are respectively in the first integrated circuit die and the second integrated circuit die.

4. The microelectronic device according to claim 1, wherein the internal power plane circuit and the internal supply voltage regulators are within a single integrated die.

5. The microelectronic device according to claim 1, wherein the external supply voltage level is at least fifty percent higher than each of the first internal supply voltage levels.

6. The microelectronic device according to claim 1, wherein:

the external power input pin has an input current limit; and an external supply current level of the input supply-side power is at the input current limit.

7. The microelectronic device according to claim 1, wherein:

the external power input pin and the external ground pin have a same current limit; and the internal supply voltage regulators and the internal ground voltage regulator are within a single integrated die.

8. The microelectronic device according to claim 1, further comprising:

a first integrated circuit die and a second integrated circuit die physically separate from the first integrated circuit die; and wherein the internal ground voltage regulator and the internal ground plane circuit are respectively in the first integrated circuit die and the second integrated circuit die.

9. The microelectronic device according to claim 1, wherein the internal ground plane circuit is configured to step-down a voltage from the ground voltage level that is higher than the negative external sink voltage level to the negative external sink voltage level.

10. A microelectronic device, comprising:

an external power input pin configured for receiving an input supply-side power, the input supply-side power having an external supply voltage level;

an internal power plane circuit coupled to the external power input pin, the internal power plane circuit being configured to provide an internal power source, the internal power plane circuit comprising a voltage converter configured to step-down a voltage from the external supply voltage level to an internal supply voltage level that is lower than the external supply voltage level;

an internal supply voltage regulator coupled to the internal power plane circuit and configured to provide an internal supply voltage by regulating the internal supply voltage level of the internal power source;

an external ground pin configured for receiving a sink-side output power having a negative external sink voltage level;

an internal ground plane circuit coupled to the external ground pin and configured to step-up a voltage from the negative external sink voltage level to a ground voltage level that is higher than the negative external sink voltage level; and an internal ground voltage regulator coupled to the internal ground plane circuit, the internal ground voltage regulator being configured to provide an internal output power to the internal ground plane circuit by regulating an internal output voltage level to the ground voltage level.

11. The microelectronic device according to claim 10, wherein the input supply-side power is equal to the external supply voltage level multiplied by an external supply current level of the input supply-side power at an input current limit of the external power input pin.

12. The microelectronic device according to claim 10, further comprising:

a first integrated circuit die and a second integrated circuit die physically separate from the first integrated circuit die; and wherein the internal power plane circuit and the internal supply voltage regulator are respectively in the first integrated circuit die and the second integrated circuit die.

13. The microelectronic device according to claim 10, wherein the internal supply voltage regulator is a first internal supply voltage regulator configured to provide a first internal supply voltage by regulating a first internal supply voltage level of a first internal power source, the microelectronic device further comprising:

a second internal voltage regulator coupled to the internal power plane circuit and configured to provide a second internal supply voltage by regulating a second internal supply voltage level of a second internal power source.

14. The microelectronic device according to claim 10, wherein:

the external power input pin has an input current limit; and an external supply current level of the input supply-side power is at the input current limit.

15. A microelectronic device, comprising:

an external power input pin configured for receiving an input supply-side power, the input supply-side power having an external supply voltage level;

an internal power plane circuit coupled to the external power input pin, the internal power plane circuit being configured to provide an internal power source, the internal power plane circuit configured to step-down a voltage from the external supply voltage level to an internal supply voltage level that is lower than the external supply voltage level;

an external ground pin configured for receiving a sink-side output power having a negative external sink voltage level;

an internal ground plane circuit coupled to the external ground pin and configured to step-up a voltage from the negative external sink voltage level to a ground voltage level that is higher than the negative external sink voltage level; and an internal ground voltage regulator coupled to the internal ground plane circuit, the internal ground voltage regulator being configured to provide an internal output power to the internal ground plane circuit by regulating an internal output voltage level to the ground voltage level.

16. The microelectronic device according to claim 15, wherein the input supply-side power is equal to the external supply voltage level multiplied by an external supply current level of the input supply-side power at an input current limit of the external power input pin.

17. The microelectronic device according to claim 15, further comprising:

a first integrated circuit die and a second integrated circuit die physically separate from the first integrated circuit die; and wherein the internal power plane circuit and an internal supply voltage regulator are respectively in the first integrated circuit die and the second integrated circuit die.

18. The microelectronic device according to claim 15, further comprising a first internal supply voltage regulator coupled to the internal power plane circuit and configured to provide a first internal supply voltage by regulating a first internal supply voltage level of a first internal power source; and a second internal voltage regulator coupled to the internal power plane circuit and configured to provide a second internal supply voltage by regulating a second internal supply voltage level of a second internal power source.

19. The microelectronic device according to claim 15, wherein:

the external power input pin has an input current limit; and an external supply current level of the input supply-side power is at the input current limit.

* * * * *